US006855100B1

(12) United States Patent
Bailey et al.

(10) Patent No.: US 6,855,100 B1
(45) Date of Patent: Feb. 15, 2005

(54) PROCESSING BLANKS IN THE MANUFACTURE OF PACKAGING

(75) Inventors: Thomas William Bailey, Coventry (GB); Andrew John Cleall, Conventry (GB); Brian Hill, Coventry (GB)

(73) Assignee: Molins PLC, Milton Keynes (GB)

( * ) Notice: Subject to any disclaimer, the term of this patent is extended or adjusted under 35 U.S.C. 154(b) by 388 days.

(21) Appl. No.: 09/642,585

(22) Filed: Aug. 22, 2000

Related U.S. Application Data

(63) Continuation of application No. PCT/GB99/00547, filed on Feb. 23, 1999.

(30) Foreign Application Priority Data

Feb. 24, 1998 (GB) ..... 9803964

(51) Int. Cl.[7] ..... B31B 3/02
(52) U.S. Cl. ..... 493/179; 493/180; 198/461.2
(58) Field of Search ..... 493/179, 180, 493/182, 264, 141; 198/461.2, 461.3, 817; 414/901

(56) References Cited

U.S. PATENT DOCUMENTS

| | | | | |
|---|---|---|---|---|
| 3,664,296 A | | 5/1972 | Stamp et al. | |
| 3,772,971 A | * | 11/1973 | Dutro et al. | 414/901 |
| 4,006,813 A | * | 2/1977 | Fluck | 198/461.2 |
| 4,006,831 A | * | 2/1977 | Jimenez | 414/901 |
| 4,746,004 A | | 5/1988 | Hess et al. | |
| 5,092,827 A | * | 3/1992 | McAdam et al. | 493/179 |
| 5,230,686 A | * | 7/1993 | McAdam et al. | 493/179 |
| 5,762,175 A | | 6/1998 | Focke et al. | |
| 5,853,360 A | | 12/1998 | Jeffrey et al. | |
| 5,997,459 A | * | 12/1999 | Kruger et al. | 493/179 |

FOREIGN PATENT DOCUMENTS

| | | |
|---|---|---|
| DE | 43 32 186 A1 | 3/1995 |
| EP | 0 095 955 A1 | 12/1983 |
| EP | 0 787 652 A1 | 8/1997 |
| GB | 1021603 | 3/1966 |
| GB | 2 195 926 | 4/1988 |
| GB | 2 282 364 | 4/1995 |

* cited by examiner

*Primary Examiner*—Eugene Kim
*Assistant Examiner*—Sameh Tawfik
(74) *Attorney, Agent, or Firm*—Antonelli, Terry, Stout & Kraus, LLP

(57) ABSTRACT

An apparatus for processing packaging blanks includes an applying device, a first conveyor, and a second conveyor. The first conveyor conveys the blanks at a first velocity arranged to permit the application of an adhesive to the blanks by means of the device. The second conveyor is arranged to receive the blanks from the first conveyor and convey them at a second velocity which is greater than the first velocity resulting in a change in the pitch of the stream of blanks conveyed by the conveyors. Alternatively the applying means may apply an adhering element such as a coupon or hologram such that it adheres to the blank. The adhering element may adhere to the blank by virtue of an adhesive carried on a rear surface of the element or by means of an adhesive carried by the blank.

12 Claims, 3 Drawing Sheets

PROCESSING BLANKS IN THE MANUFACTURE OF PACKAGING

This application is a continuation of international application number PCT PCT/GB99/00547, filed 23 Feb. 1999.

FIELD OF THE INVENTION

The invention relates to the processing of blanks in the manufacture of packaging and particularly, but not exclusively to apparatus for processing carton blanks in the manufacture of cigarette cartons.

SUMMARY OF THE INVENTION

The invention provides apparatus for processing packaging blanks, said apparatus includes an applying means, a first conveyor arranged to convey packaging blanks at a first conveying velocity through an application region in which an adhesive or at least one adhering element is applied to each blank by said applying means and a second conveyor arranged to receive said blanks from said first conveyor and convey said blanks at a second velocity which is greater than said first velocity.

Preferably, the conveyors are disposed in end-to-end relationship such that said blanks are transferred directly from said first conveyor to said second conveyor.

The invention also includes a method of processing packaging blanks comprising passing blanks through a first region at a first speed; applying an adhesive or at least one adhesive element to each of said blanks as they travel through the first region; thereafter passing said blanks through a second region at second speed wherein said second speed is greater than said first speed.

The invention also includes an apparatus for use in processing packaging blanks, said apparatus comprising a first conveying means comprising two conveyors for conveying respective streams of packaging blanks, a second conveying means comprising a first conveyor for receiving the said stream of blanks conveyed by one of said two conveyors and a second conveyor for receiving the said stream of blanks conveyed the other of said two conveyors and blank transferring means for transferring blanks between the said conveyors of said second conveying means, wherein at least said first conveyor of said second conveying means is arranged to convey the blanks conveyed thereon at a conveying velocity which is greater than the conveying velocity of the respective conveyor of said first conveying means such that the stream of blanks conveyed by at least said first conveyor of said second conveying means has a pitch greater than the respective stream of blanks conveyed by said first conveying means such that said blank transferring means can insert the blanks conveyed by said second conveyor into spaces between the blanks of the stream of blanks conveyed by said first conveyor.

By virtue of this aspect of the invention multiple streams of blanks which may be moving at a first velocity selected to suit a processing device such as an adhesives applying means can be combined into a single stream of blanks moving at a second velocity which is greater than said first velocity in order to obtain the advantage of the higher processing speed capability of devices such as folding machines which are disposed downstream of the blank transferring means.

Advantageously, the conveyors of said second conveying means are arranged such that the respective streams of blanks conveyed thereon have a predetermined out of phase relationship.

Preferably, said first conveyor and said second conveyor are each arranged to accelerate the streams of blanks conveyed thereon to a conveying velocity greater than the conveying velocity of the respective conveyors of said first conveying means.

Preferably, said blank transferring means is arranged to insert the blanks conveyed by said one conveyor of the second conveying means into said spaces between the stream of blanks conveyed by said other conveyor of said second conveying means so as to provide a stream of blanks comprised alternately of blanks from said one conveyor and said other conveyor.

According to each of the above-mentioned aspects of the invention, the pitch of a stream of blanks along a conveying path is altered by having adjacent conveyors operating with different conveying velocities. By this means the pitch and speed at which the blanks are conveyed past various processing devices can be readily modified to suit the operating characteristics of those devices and/or two streams of blanks may be combined.

BRIEF DESCRIPTION OF THE DRAWINGS

In order that the invention may be well understood, some embodiments thereof, which are given by way of example only, will now be described with reference to the drawings in which.

DETAILED DESCRIPTION OF THE DRAWINGS

Figure 1:
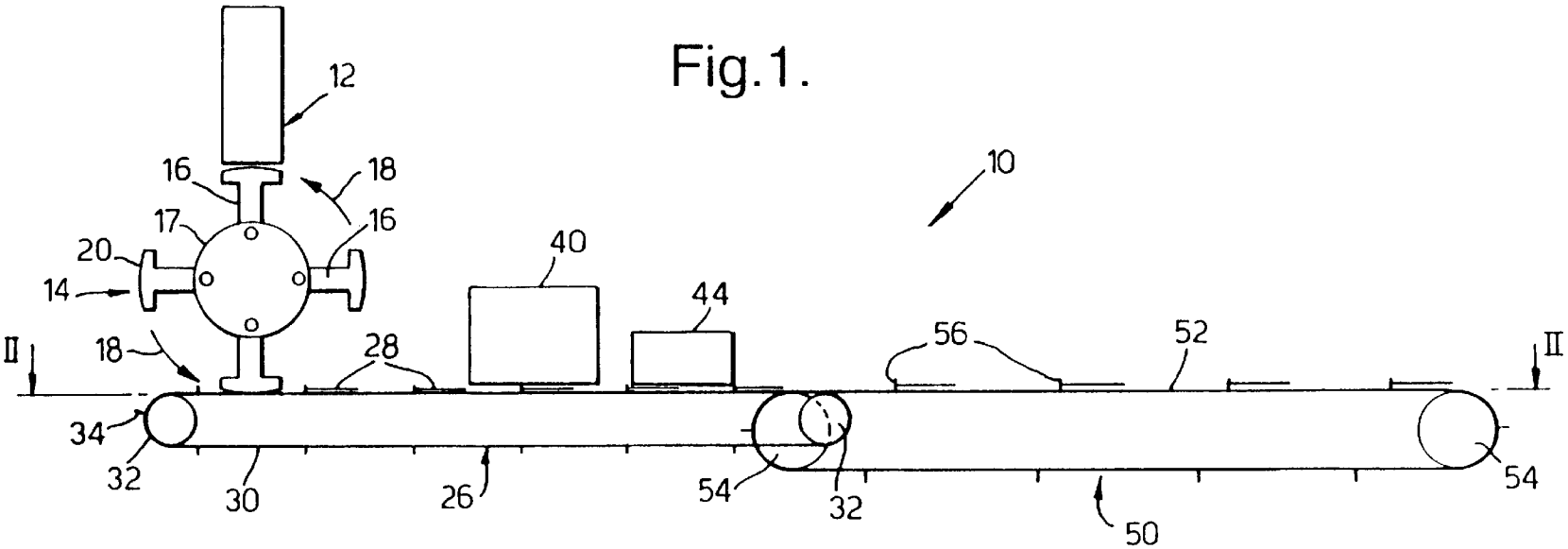
FIG. 1 is a schematic side elevation of apparatus for use in manufacturing cigarette cartons.
Figure 2:
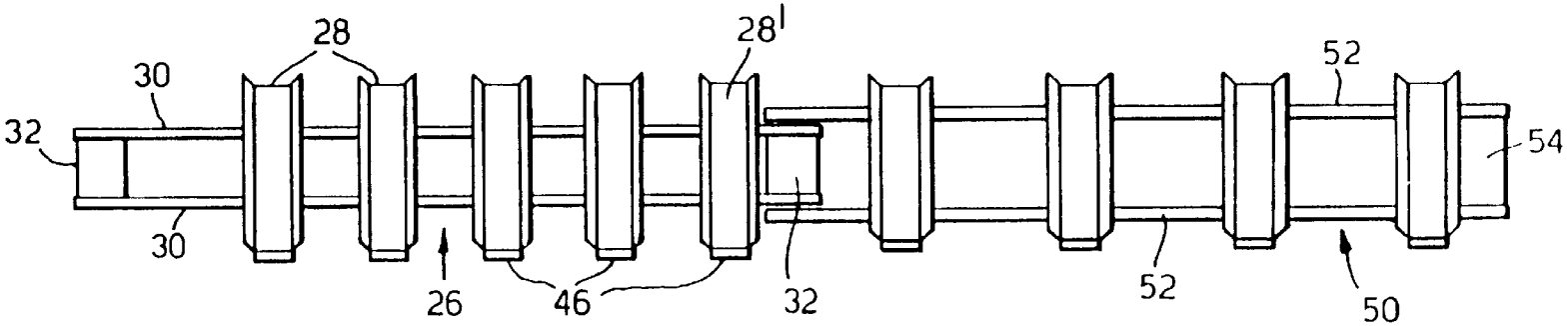
FIG. 2 is a plan view along line II—II in FIG. 1 showing the disposition of carton blanks transported on the conveyors.

Referring to FIGS. 1 and 2, an apparatus 10 for processing blanks in the manufacture of cartons for cigarettes comprises a carton blank magazine 12 and a blank feeding device 14 for removing blanks from the magazine and feeding them one-by-one onto a conveyor system which is described in detail hereinbelow.

The device 14 comprises a plurality of arms 16 which are carried on a drum 17. The drum is rotatable about a fixed axis as indicated by the arrows 18 in FIG. 1. The arms 16 are pivotally mounted to the drum 17 so as to be capable of moving back-and-forth in the circumferential direction of the drum and each. carries a suction head 20 at its radially outermost end. The heads 20 are provided with suction pads (not shown).

The motion of the arms 16 relative to the drum is controlled by a cam system. The effect of the cam system is that as the suction pads of a head 20 engage and grip the lowermost blank held in the magazine, the head rocks back in the direction opposite to the direction of rotation of the drum 17 to facilitate removal of the blank from the magazine. Subsequently, as the arm is carried past the magazine, the head rocks forward (i.e, in the direction of rotation of the drum) under control of the cam system so as to resume a position in which its axis extends radially with respect to the drum.

The device 14 is described in detail in our United Kingdom patent application no GB 9706261.6 filed on 26 Mar. 1997 the content of which is incorporated herein by reference.

The conveyor system comprises a first conveyor 26 which is arranged to receive blanks from the device 14. To this end, the suction pads of the suction heads 20 are deactivated as the heads approach the conveyor 26 so that the blanks are deposited on the conveyor; blanks deposited on the conveyor are indicated by reference numeral 28 in the figures.

The conveyor 26 comprises two endless belts 30 which are carried on pulleys 32 disposed at each end of the conveyor. In the usual way, one of the pulleys 32 is driven to cause movement of the belts 30. The belts 30 carry battens, or bars, 34 which are known as pushers and extend in a direction transverse to the direction of travel of the belts. The pushers 34 are evenly distributed along the length of the belts and serve to engage the trailing edge of the blanks 28 to ensure that the blanks are carried along the length of the conveyor (to the right in FIG. 1).

An adhesives applicator 40 is positioned adjacent the conveyor 26 to apply an adhesive, for example PVA, to a predetermined portion, or portions, of each blank. The adhesives applicator 40 is of the wheel-type which is a device well known to those skilled in the art and accordingly will not be described in more detail herein. Suitable wheel-type applicators are described in U.S. Pat. No. 2,615,422, U.S. Pat. No. 3,162,546 and GB2093739.

A folding machine 44 is disposed downstream of the adhesives applicator 40 and is arranged to fold an upper flap portion 46 of each blank 28 to a position (see the blank 28' in FIG. 2) in which it is held by means of the adhesive applied by the applicator.

The apparatus 10 further comprises a second conveyor 50 which is positioned at the downstream end of the first conveyor 26. The construction of the second conveyor 50 corresponds to that of the first conveyor in that it comprises two endless belts 52, two pulleys 54 and transverse battens 56.

It will be noted that the conveyors 26, 50 are arranged in end-to-end and overlapping relationship so that the blanks 28' are transferred directly from the downstream end of the conveyor 26 to the upstream end of the conveyor 50 thereby maintaining a continuous flow of blanks 28 away from the folding machine 44.

The conveyors 26, 50 are driven at different speeds. This can be done either by providing individual drive systems which are arranged to provide different operating speeds for the conveyors, or where a common drive unit is utilised, by means of a suitable gearing arrangement.

In more detail, the first conveyor 26 is driven at a slower speed than the second conveyor 50; for example, the first conveyor may be driven so as to convey blanks at approximately one half the velocity at which they are conveyed on the second conveyor. One effect of this, as best seen in FIG. 2, is that the spacing between the blanks (i.e, the pitch) on the two conveyors is different. In the case where the velocity of the first conveyor is one half the velocity of the second conveyor, the pitch for the blanks on the first conveyor is one half the pitch for the second conveyor.

Figure 3:
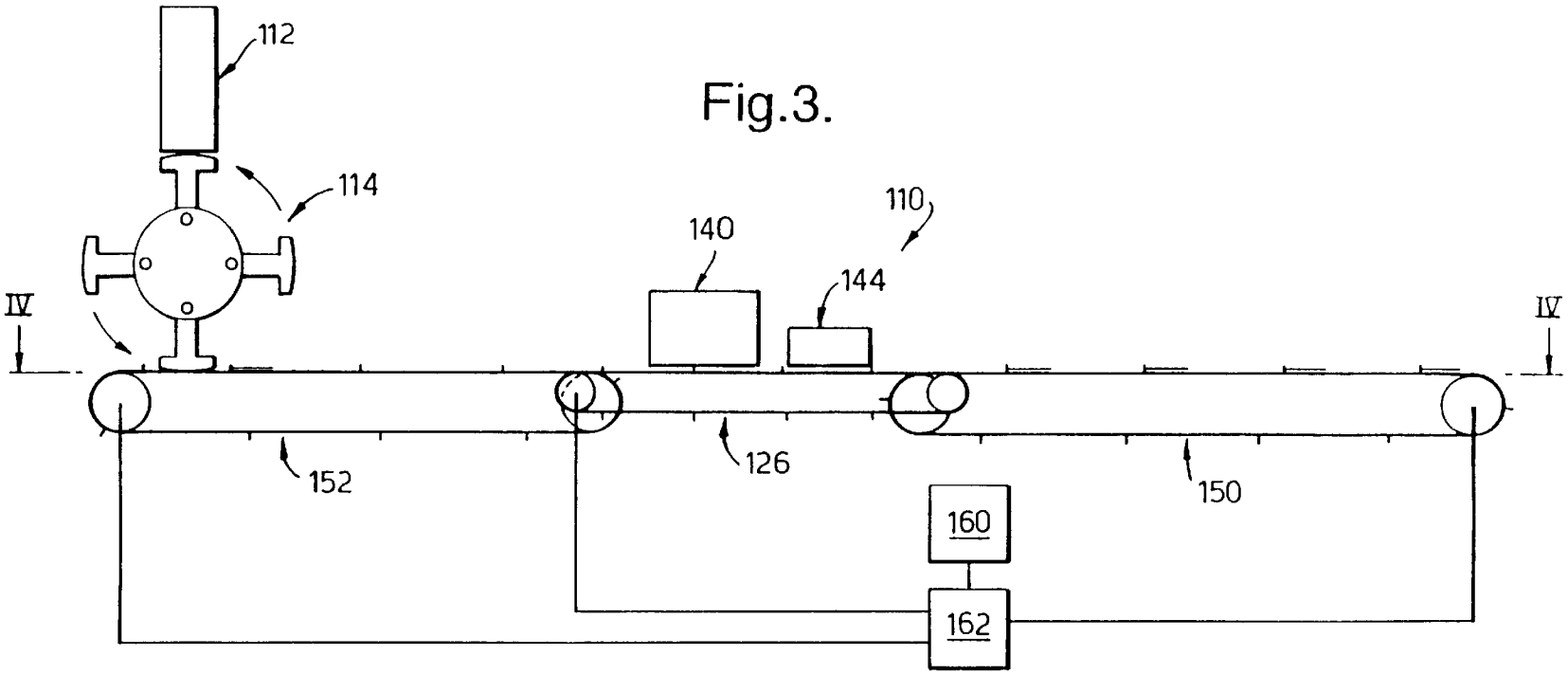
FIG. 3 is a schematic side elevation of another apparatus for use in manufacturing cigarette cartons.
Figure 4:
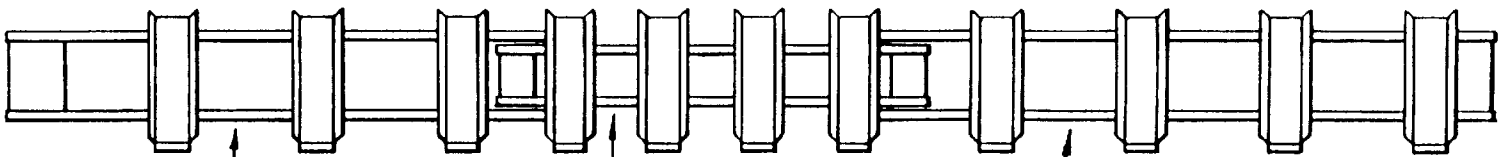
FIG. 4 is a plan view along line IV—IV in FIG. 3 showing the distribution of carton blanks transported on the conveyors.

FIGS. 3 and 4 show another apparatus 110 for use in the manufacture of cigarette cartons. Parts of the apparatus which correspond to parts shown in FIGS. 1 and 2 have been given a similar reference numeral to which 100 has been added.

The apparatus 110 comprises a carton magazine 112, a blank feeding device 114, a first conveyor 126, an adhesives applicator 140, a folding machine 144 and a second conveyor 150.

In addition to the conveyors 126, 150, the apparatus 110 comprises a third conveyor 152 which is disposed upstream of the conveyor 126. The construction of the third conveyor corresponds to that of the first conveyor 126 and will not therefore be described in detail.

A motor drive 160 is provided for driving the conveyors 126, 150, 152. The motor drive 160 is connected to the conveyors by way of a gearing system 162 which is arranged such that the individual conveyors do not operate at the same speed as described in more detail below.

As shown in FIG. 3, the blank feeding device 114 is arranged to feed carton blanks onto the third conveyor 152. The blanks on the conveyor 152 are conveyed to the conveyor 126. The conveyors 152, 126 are arranged in end-to-end and overlapping relationship so that the blanks are transferred directly from the downstream end of the conveyor 152 onto the upstream end of the conveyor 126. Whilst travelling along the conveyor 126 each of the blanks is subject to gluing and folding operations by the adhesives applicator 140 and folding machine 144.

As with the apparatus 10, the first conveyor 126 conveys blanks at a velocity which is approximately one half that at which they are conveyed by the second conveyor 150. The third conveyor 152 conveys the blanks at approximately the same velocity as the second conveyor 150. Thus whilst travelling along the apparatus 110, the blanks are first decelerated on reaching the conveyor 126 and subsequently accelerated back to the original conveying velocity on being transferred onto the conveyor 150 with consequent changes in pitch which are illustrated in FIG. 4. Specifically, the pitch is reduced when the blanks are transferred onto the slower moving conveyor 126 and, since the conveyor 150 runs at the same speed as the conveyor 152, returned to the original spacing when they are transferred to the conveyor 150.

It will be appreciated that by providing a continuous conveyor system with adjacent conveyors which are operated at different speeds, it is possible to match the conveyed velocity and pitch of the blanks to the operating characteristics of the various processing machines which operate on the blanks. Where a wheel-type adhesives applicator is used, it is necessary that the velocity at which the blank is conveyed is substantially the same as the velocity of the periphery of the applicator wheel. The applicator wheel velocity is typically rather low and therefore in order to achieve a satisfactory throughput of blanks it is necessary to reduce the pitch of the blanks as much as possible. However, such a reduced pitch may not be suitable for subsequent processing operations on the blanks. Thus, the arrangements shown in FIGS. 1 and 3 provide the advantage that the pitch of the blanks can readily be increased downstream of the adhesives applicator to a pitch which is more suitable for subsequent operations.

The apparatus 110 has the additional advantage, as compared with the apparatus 10, that the blank feeding device is not restricted to an operating speed which is suited to the adhesives applicator. It will be appreciated that it is not essential for the operating speeds of the conveyors 150, 152 to be the same. Instead, whilst both operate at a higher speed than the conveyor 126, the conveyor 150 might be operated at a higher speed than the conveyor 152. It will be appreciated that by operating the conveyor 150 at a higher speed than the conveyor 152, the pitch of the stream of blanks conveyed on the conveyor 150 will be greater than that of the stream conveyed by the conveyor 152 which may be desirable to facilitate processing operations to be performed on the blanks downstream of the folding machine 144 and match the speed of the conveyor 152 to the operating speed of the blank feeding device 144.

Figure 5:
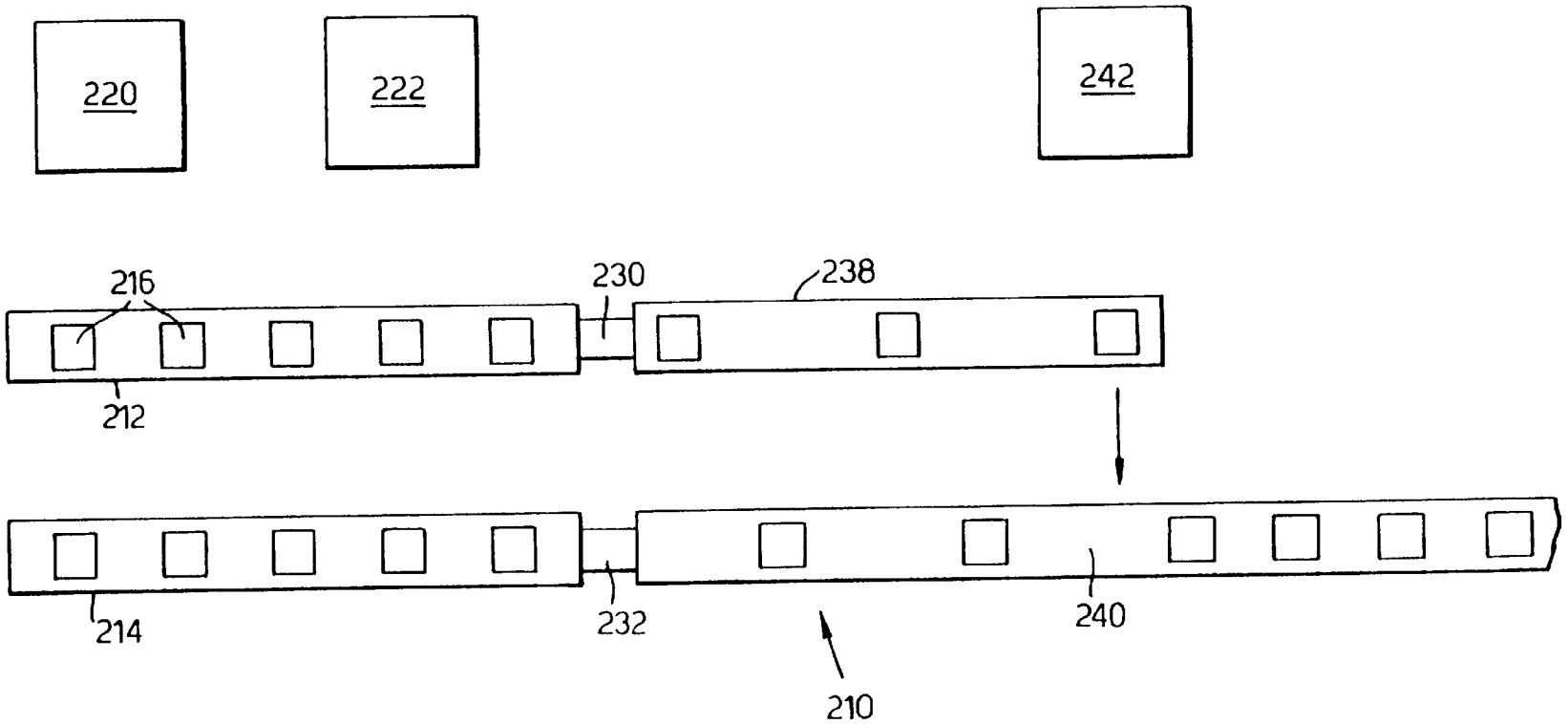
FIG. 5 is a schematic representation of yet another apparatus for use in manufacturing cigarette cartons.

A third apparatus 210 for use in manufacturing cartons is schematically represented in FIG. 5. The apparatus 210 comprises two conveyors 212, 214 disposed in a twin track arrangement and each receiving carton blanks 216 from a blank feed device (not shown).

The conveyors 212, 214 convey the blanks past an adhesives applicator apparatus 220 and a folding apparatus 222. The conveyors may be multi-belt conveyors (as shown in FIGS. 2 and 4) or simply have a single belt and in either case have pushers (not shown) for engaging the trailing edges of the blanks. Respective deadplates 230, 232 are provided at the downstream ends of the conveyors 212, 214. Beyond the deadplates are respective conveyors 238, 240. Again these conveyors 238, 240 may have a single-belt or multiple belts as desired and are provided with pushers (not shown) for engaging the trailing edges of the blanks.

A transfer device 242 is provided adjacent the downstream end of the conveyor 238. The transfer device transfers carton blanks from the conveyor 238 to the conveyor 240 and may be a pusher unit which pushes the cartons in a direction transverse to the direction of travel of the conveyors or alternatively some form of pick-and-place device. Such apparatus for transferring parts between conveyors will be well known to those skilled in the art and will not therefore be described in detail herein.

The conveyors 212, 214 convey the blanks 216 at a velocity selected to suit the applicator wheels of the adhesives applicator apparatus 220. On reaching the downstream end of the conveyors 212, 214, the blanks are momentarily held on the respective deadplates 230, 232 and then swept onto the respective conveyors 238, 240 as they are engaged by the cross-bars of those conveyors. The pushers of the conveyors 238, 240 are arranged to provide a staggered pick up of blanks at the deadplates such that the flow of blanks on those conveyors is out of phase; this phase relationship is shown in FIG. 5. Additionally, the conveyors 238, 240 have a conveying velocity which is greater than that of the conveyors 212, 214 which has the result that the pitch of the stream of blanks is increased as the blanks are accelerated at the upstream end of the conveyors 238, 240.

The transfer device 242 transfers blanks from the downstream end of the conveyor 238 to the conveyor 240, inserting them into the spaces between the blanks on the latter conveyor. As shown, this has the effect of reducing the pitch of the stream of blanks on the conveyor 240 downstream of the transfer device.

It will be understood that by means of the apparatus 210, two relatively slow moving streams of blanks may be combined to form a single fast moving stream. Thus, for example, the conveyors 214, 216 may each be conveying 500 blanks per minute whilst downstream of the transfer device 242 the conveyor 240 is conveying 1000 blanks per minute.

It will be appreciated that the apparatus 210 allows the combination of two streams of blanks moving at a relatively low speed which is governed by the adhesives applicator and/or the blank feeding devices into one fast moving stream thereby obtaining the benefit of a higher speed capability of apparatus further down the line in the carton making process. In this connection, it will be understood that the apparatus 210 may be simplified by positioning the folding apparatus 222 downstream of the transfer device 242 to operate on the combined flow of blanks conveyed by the conveyor 240. It will also be understood that by suitable selection of the speed of the conveyors 238, 240, the pitch of the combined stream of blanks on the conveyor 240 may be greater than the pitch of the streams of blanks on the conveyors 212, 214.

As an alternative to utilising deadplates and out of phase pushers, the out of phase relationship could be generated by having the conveyors 238, 240 running with different conveying velocities at least one of which is greater than the conveying velocity of the conveyors 214, 216.

It will be understood that even where the two conveyors 238, 240 are not arranged to generate an out of phase relationship between the respective streams of blanks conveyed thereon, the streams may nonetheless be combined by a suitable arrangement of the transfer device such that the blanks are transferred from the conveyor 238 into the spaces generated by increasing the pitch of the stream of blanks conveyed along the conveying path defined by the conveyors 214, 240. For example, instead of pushing the blanks along path which is substantially normal to the lengthwise direction of the conveyors as shown in FIG. 5, the blanks could be pushed at an angle which is inclined to the aforesaid lengthwise direction.

The apparatus have been described in relation to the application of adhesives to carton blanks by means of wheel-type applicators. Although particularly suited to that purpose, the apparatus is considered equally suitable for use with alternative adhesives application devices such as, for example, spray applicators or extrusion ('slot die') coating devices.

It will also be appreciated that although in the embodiments the conveyors are flat-belt conveyors, other conveyors, such as rotary drum conveyors or rotors, would also be suitable.

It will be appreciated that instead of pushers, the conveyors may utilise a vacuum system to hold the blanks in the required position.

It will be appreciated that instead of applying an adhesive, the apparatus may be used to apply an adhesives carrying element or elements to the blanks. For example, as a direct substitute for an adhesive, a double-sided sticky patch could be applied. Alternatively a hologram, coupon or a label carrying an adhesive on its rear face may be applied to the blanks. Alternatively the adhering element may adhere to the blank by virtue of an adhesive, which may be heat or pressure activated, carried by the blank.

It will be appreciated that in its broader aspects the invention is applicable to processing situations other than the application of an adhesive to a carton blank in which it is desired to alter the pitch of the parts conveyed and/or merge parallel running streams of parts into a single stream.

What is claimed is:

1. Apparatus for use in processing packaging blanks, said apparatus comprising first upstream conveying means comprising two upstream conveyors for conveying in parallel two respective streams of packaging blanks, second downstream conveying means comprising a first downstream conveyor for receiving the said stream of blanks conveyed by one of said two upstream conveyors and a second downstream conveyor for receiving in parallel to said first downstream conveyor the said stream of blanks convey ed the other of said two upstream conveyors and blank transferring means for transferring blanks between the conveyors of said downstream conveying means; wherein at least said first downstream conveyor is arranged to convey the blanks conveyed thereon at a conveying velocity which is great than the conveying velocity of said one upstream conveyor such that the stream of blanks conveyed by at least said first downstream conveyor has a pitch greater than the respective stream of blanks conveyed by said first upstream conveying means, said blank transferring means being adapted to insert the blanks conveyed by said second downstream conveyor into spaces between the blanks of the stream of blanks conveyed by said first downstream conveyor.

2. Apparatus as claimed in claim 1, wherein the conveyors of said second downstream conveying means are arranged such that the respective streams of blanks conveyed thereon are staggered with respect to each other.

3. Apparatus as claimed in claim 1, wherein said first downstream conveyor and said second downstream conveyor are each arranged to accelerate the streams of blanks conveyed thereon to a conveying velocity greater than the conveying velocity of the respective conveyors of said first upstream conveying means.

4. Apparatus as claimed in claim 1, wherein each conveyor of said second downstream conveying means comprises a plurality of substantially equally spaced apart members arranged for engaging a trailing edge of the blanks conveyed thereon.

5. Apparatus as claimed in claim 1, wherein said blank transferring means is arranged to insert the blanks conveyed by said second downstream conveyor into said spaces between the stream of blanks conveyed by said first downstream conveyor so as to provide a stream of blanks comprised alternately of blanks from said first downstream conveyor and said second downstream conveyor.

6. Apparatus as claimed in claim 1, wherein said blank transferring means is arranged to push blanks from said second downstream conveyor onto said first downstream conveyor.

7. Apparatus as claimed in claim 1, wherein said first downstream conveyor and said second downstream conveyor are disposed in a substantially parallel spaced apart relationship and said blank transferring means is arranged to move blanks from said second downstream conveyor to said first downstream conveyor by moving said blanks in a direction normal to the direction of travel of said first downstream conveyor and said second downstream conveyor.

8. Apparatus as claimed in claim 1, further comprising respective deadplates between said conveyors of said first upstream conveying means and said conveyors of said second downstream conveying means.

9. Apparatus as claimed in claim 1, further comprising applying means for applying an adhesive or at least one adhering element to each blank conveyed by said conveyors of said first upstream conveying means.

10. Apparatus as claimed in claim 9, wherein said applying means comprises a plurality of applicator wheels for applying an adhesive arranged such that each conveyor of said first upstream conveyor means has a least one applicator wheel associated therewith.

11. Apparatus as claimed in claim 1, further comprising blank feeding means for feeding blanks one-by-one onto conveyor of said first upstream conveyor means to form said respective streams of carton blanks.

12. Apparatus as claimed in claim 11, wherein said blank feeding means and said conveyors of said first upstream conveying means are arranged such that said respective streams of blanks have substantially the same pitch and are in an in-phase relationship.

* * * * *